US005886326A

United States Patent [19]

Tang

[11] Patent Number: 5,886,326

[45] Date of Patent: Mar. 23, 1999

[54] MICROWAVE WASTE INCINERATOR

[75] Inventor: Kenneth Y. Tang, Alpine, Calif.

[73] Assignee: ThermoTrex Corporation, San Diego, Calif.

[21] Appl. No.: 588,989

[22] Filed: Jan. 19, 1996

[51] Int. Cl.[6] ..... H05B 6/80

[52] U.S. Cl. ..... 219/679; 219/685; 219/686; 219/759; 219/762; 34/257; 34/263; 110/250; 588/227

[58] Field of Search ..... 219/679, 678, 219/681, 685, 686, 730, 759, 762; 110/250, 252, 346; 34/256, 257, 259, 263, 265; 422/21; 588/227, 228

[56] References Cited

U.S. PATENT DOCUMENTS

| | | | |
|---|---|---|---|
| 4,937,411 | 6/1990 | Suzuki et al. . | |
| 5,003,143 | 3/1991 | Marks et al. | 219/686 |
| 5,154,862 | 10/1992 | Reagan et al. . | |
| 5,191,184 | 3/1993 | Shin | 219/679 |
| 5,322,603 | 6/1994 | Kameda et al. | 204/158.2 |
| 5,335,425 | 8/1994 | Tomizawa et al. | 34/265 |

FOREIGN PATENT DOCUMENTS

| | | | |
|---|---|---|---|
| 2-306011 | 12/1990 | Japan | 219/685 |
| 4-98787 | 3/1992 | Japan . | |

*Primary Examiner*—Philip H. Leung
*Attorney, Agent, or Firm*—Fish & Richardson P.C.

[57] ABSTRACT

A microwave incinerator is configured to incinerate waste material. The waste material is installed within a microwave absorbing shroud located in a microwave chamber. The combination of low microwave heat input and a vacuum drawn on the chamber vaporizes the water in the garbage. During this first phase there is no combustion because of the relatively low temperature and the lack of oxygen. Once the material is dry, intense microwave energy is applied to the chamber heating the silicon carbide shroud to an elevated temperature in the range of about 500 to 1000 degrees C. Concurrent with the rapid rise in temperature, air containing oxygen is pumped into the chamber. The hot shroud ignites the material, after which heat is provided is a combination of combustion heat and microwave energy. The temperature is monitored and the microwave energy input is controlled to assure a controlled burn of the waste material.

40 Claims, 4 Drawing Sheets

MICROWAVE WASTE INCINERATOR

This invention relates to incinerators and especially to microwave incinerators.

BACKGROUND OF THE INVENTION

Garbage disposal is a very serious problem in the United States and in many other areas of the world. Land fills in most urban areas are becoming over burdened and new sites are extremely difficult to establish because people generally do not want them in their communities. Many people own a mechanical garbage disposal unit which grinds up kitchen type garbage which is then flushed down the drain.

Another solution to garbage is incineration. Various types of incinerators have been proposed, and some are in use to treat waste such as radioactive, toxic or other hazardous wastes, but none have gained wide spread use. There has been no significant use of incinerators for residential garbage disposal.

Several incinerator designs have been proposed which utilize a microwave source such as a magnetron to assure combustion of the garbage. Microwaves are very effective at heating water; therefore, this energy source is good for drying the garbage. The absorption of microwaves in other materials varies widely. However, once garbage begins to burn and plasmas are generated the plasmas are very good absorbers of microwave energy.

Silicon carbide is known to be a good absorber of microwave energy. In U.S. Pat. No. 4,937,411, Suzuki proposed the use of a silicon carbide plate at the bottom of one of his combustion chambers for the purpose of absorbing microwaves to increase the heat input into the chamber.

Prior art microwave incinerators are typically complicated, expensive and unreliable. What is needed is a better microwave incinerator low enough in cost and simple enough in operation that it can be made available to the residential market.

SUMMARY OF THE INVENTION

The present invention provides a microwave waste material incinerator. The material is installed within a microwave absorbing shroud located in a microwave chamber. The combination of low microwave heat input and a vacuum drawn on the chamber vaporizes the water in the material. During this first phase there is no combustion because of the relatively low temperature and the lack of oxygen. Once the material is dry, intense microwave energy is applied to the chamber quickly heating the silicon carbide shroud to an elevated temperature in excess of 500 degrees C. Concurrent with the rapid rise in temperature, air containing oxygen is pumped into the chamber. The hot shroud ignites the material, after which heat is provided as a combination of combustion heat and microwave energy. The temperature is monitored and the microwave energy input is controlled to assure a controlled burn of the material.

In a preferred embodiment, water removed from the material is exhausted from the chamber and either collected or directed to a sewer system and ash left over from the incineration is vacuumed into a garbage container. Gases are filtered and vented to the atmosphere.

DETAILED DESCRIPTION OF PREFERRED EMBODIMENTS

Incineration Chamber

Figure 1:
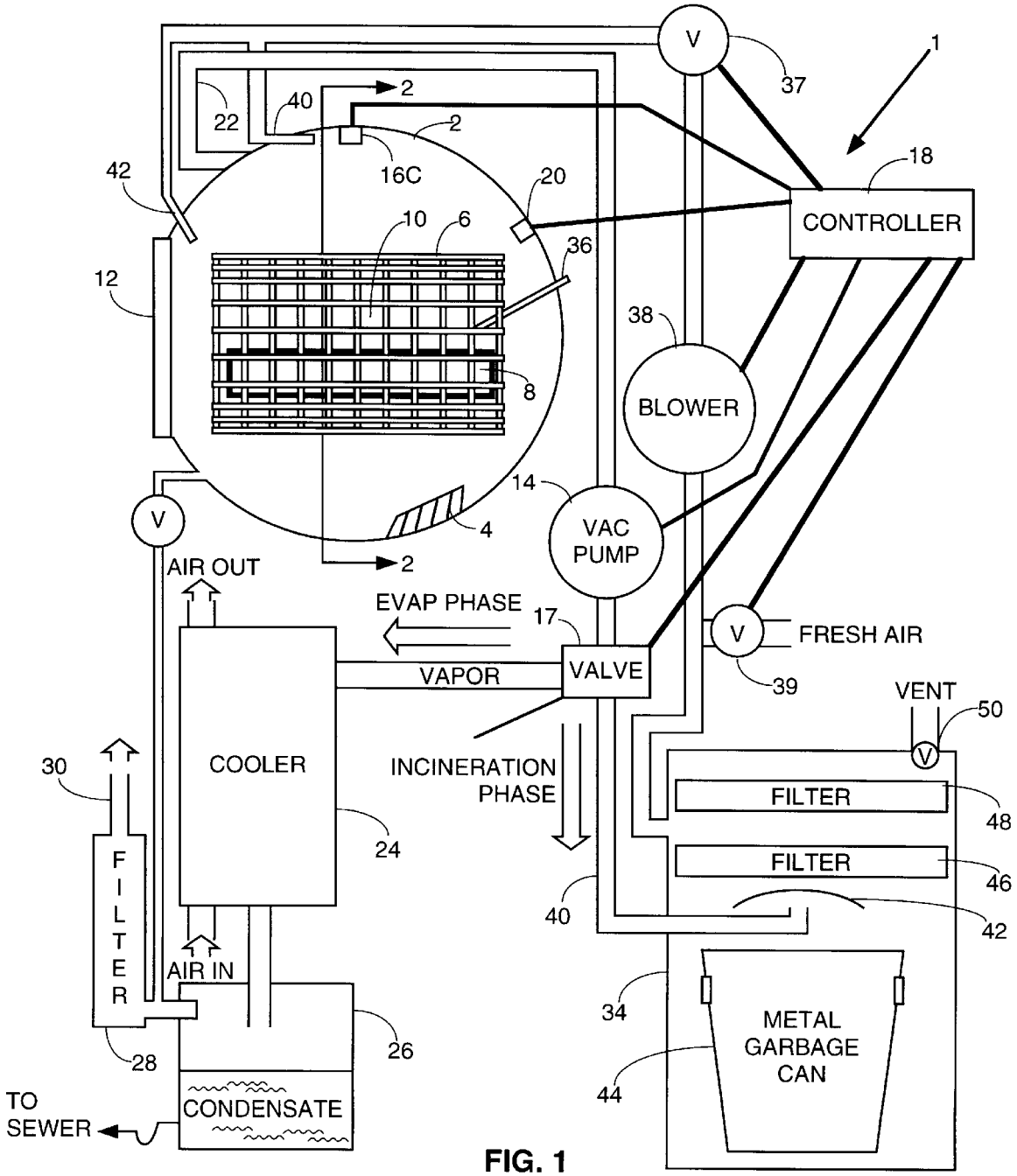
FIG. 1 is a drawing showing a preferred embodiment of the present invention.

A preferred embodiment of the present invention is described by reference to the drawings. Shown in FIG. 1 are the principal elements of this preferred embodiment which will be referred to herein as incinerator unit 1. Incineration chamber 2 is a generally spherical chamber capable of sustaining pressures of at least 25 psi and an absolute vacuum. The entire inside surface is lined with an appropriate high temperature ceramic insulator material 4. Chamber should be housed in an appropriate housing (not shown) with sufficient insulation (also not shown) in between the chamber and the housing. Located inside chamber 2 is microwave absorbing shroud 6 which consist in this embodiment of an open ended cylindrical tube made of woven strands of carbon fiber coated with silicon carbide, described further below. The tube has an inside diameter of about nine inches. Garbage tray 8 is loaded with garbage 10 to be incinerated and the tray with the garbage is inserted in chamber 2 through door 12. Door 12 with an appropriate high temperature gasket provides a vacuum seal and a latch on door 12 is sufficient to withstand a pressure of 25 psi on the door. When the incinerator unit 1 is activated, it cycles first through an evaporation phase and then through an incineration phase.

Evaporation Phase

Figure 2:
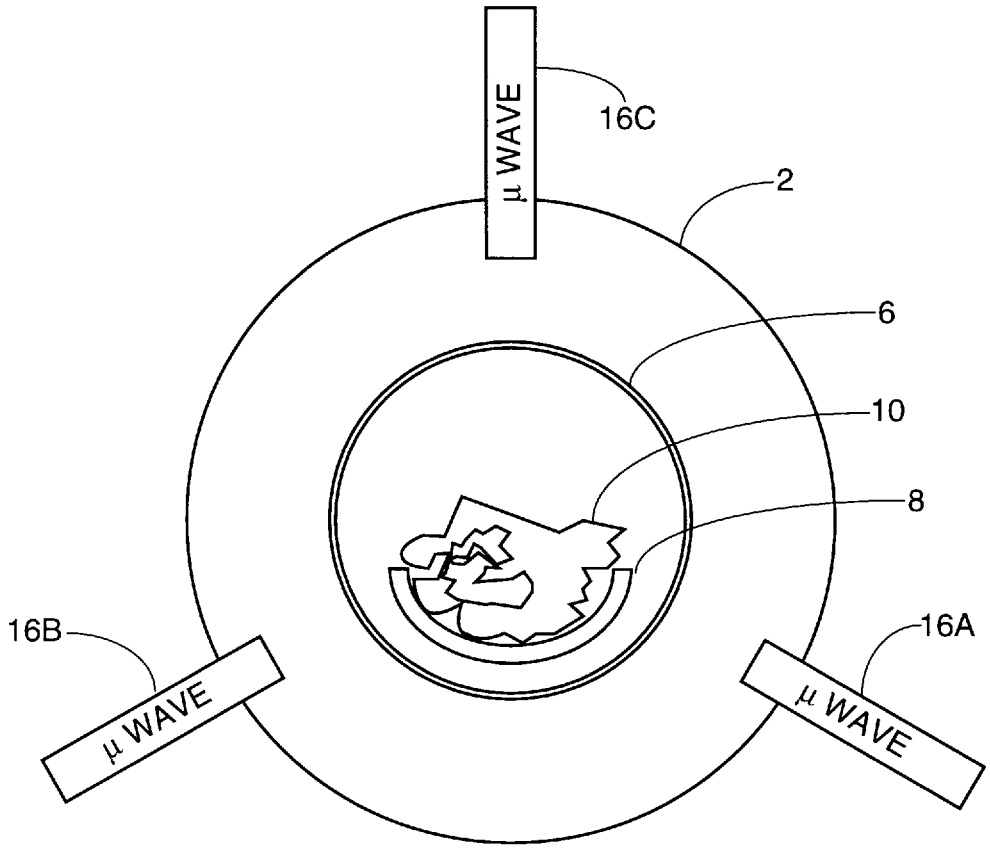
FIG. 2 is a sectional view of a portion of the embodiment shown in FIG. 1.

Vacuum pump 14 provides a quick vacuum of −6 psig in chamber 2. Microwave generators 16 A, B and C (shown in FIG. 2), which in this embodiment are three 400 watt magnetrons, operating at a frequency of about 800 MHz, are energized and controlled by controller 18 to maintain a temperature, as monitored by temperature sensor 20, in chamber 2 during the evaporation phase of between 90 degrees C. and 120 degrees C. Since silicon carbide is a good absorber of 800 MHz microwave energy substantially all of the microwave energy is absorbed in the silicon carbide shroud 6 which in turn heats the garbage 10 vaporizing a substantial portion of the water and other low temperature volatile materials in the garbage. The vapor is drawn through pipe 22 by vacuum blower 14. During this phase, two-way valve 17 directs the vapor from chamber 2 to cooler 24 where much of the vapor is condensed and drained into condensate storage tank 26. These condensates are typically allowed to drain directly into a sewer system but may be otherwise disposed of. Gases passing through cooler 24 which do not condense out are either recirculated back through chamber 2 or directed through filter 28 to vent 30. Controller 18 is programed to determine when the garbage is dry by reduced heating requirements to maintain temperature (or alternatively by a operator set timer) and when this determination is made controller 18 switches incinerator unit 1 to the incineration phase.

Incineration Phase

Upon initiation of the incineration phase, magnetrons 16 A, B and C are immediately switched to full power of 400 watts each. The SiC will in this condition heat up very rapidly via absorption of the microwave radiation and as the temperature of the SiC rises it becomes a better absorber of microwave energy because of its negative temperature coefficient of resistivity. Silicon carbide shroud 6 heats within about two minutes to about 600 degrees C. but there is no ignition of garbage 10 because of the lack of oxygen in chamber 2. When the temperature in the chamber reaches about 600 degrees C. controller 18 switches two-way valve 17 to incineration phase directing gasses in pipe 22 through pipe 41 to ash collector 34, opens valve 37 and turns on blower 38 to blow oxygen-containing air into chamber 2. These actions ignite the now dry garbage 10. As garbage 10 burns, controller 18 regulates the heat input from magnetrons 16 and the air flow from blower 38 and fresh air valve 39 to achieve complete combustion of garbage 10. The final incineration stage will use mostly RF heat as the combustibles in the garbage are burned up. The oxygen content and temperature are controlled in part by the controlled recirculation of exhaust gases. It is important to avoid excessively high temperatures to limit production of NOX. Controller 18 may be programed to operate the incineration phase for a time set by a human operator. This may be about 5 minutes after which time interval, the garbage has been completely incinerated and turned to ash. Excellent thorough combustion is accomplished through the very high temperature and the controlled supply of oxygen.

Ash Collection

Controller 18 allows the unit to cool down somewhat, closes down somewhat on fresh air valve 39 and then increases the output of blower 38 to full flow which sends jets of air through jet nozzles 40 and 42 creating a tornado effect in chamber 2 entraining the ash resulting from the incineration in the rapidly circulating air which is vacuumed out of chamber 2 through pipe 22 into ash collector 34 through the combined action of blower 38 and vacuum blower 14. Ash exits pipe 41 impinging against reflector 43 and drops into metal garbage can 44. Gases exiting pipe 41 pass through first filter 46 and back into chamber 2 or first filter 46 and second filter 48 and then are vented to the atmosphere. (Vent valve 50 may be set to open either in or out at about plus or minus 0.5 psig to prevent the over pressuring or under pressuring of ash collector 34.) Since the quantity of ash is a very small fraction of the quantity of garbage which creates the ash, Applicant estimates that a normal household used to filling one or two 30 gallon garbage cans once per week will need to dispose of the ash collected in metal garbage can 44 about twice per year!

Silicon Carbide Microwave Absorbing Shroud

Microwave absorbing shroud 6 in this preferred embodiment, as stated above comprises a preform made of a very thin (micron size) carbon fibers woven into 1/10 inch carbon strands which are in turn woven into a rigid cylindrical tube having a diameter of about 9 inches and ¼ inch spacings between the strands. These tubes are commercially available and are referred to as open mesh braided tubes. These tubes resemble the leg portion of a fishnet stocking except the stands are larger and the tube is stiff. This carbon fiber braided tube has been coated with silicon carbide to protect the substrate carbon fiber structure from the high temperature oxidizing atmosphere of the incinerator. Applicant's preferred method of coating the carbon fiber structure is with special chemical vapor deposition method utilizing the process described in U.S. Pat. No. 5,154,862 which is incorporated herein by reference. The woven rigid preform cylindrical carbon fiber tube is placed within a graphite cylindrical tube having an inside diameter about twice the size of the diameter of the preform. During the vapor deposition process, the graphite tube is heated to the deposition temperature as specified in the patent and rotated at about 1 RPM. This permits coating on all exposed surfaces of the preform. The rotation causes a rolling of the preform within the graphite tube and prevents bonding between the preform and the inside of the graphite tube. It is recommended that a coating of about 30 mills be applied to the carbon fiber preform. The resulting structure is excellently suited for this application. The shroud is extremely resistant to corrosion. It can withstand thousands of temperature cycles from room temperature to more than 1,000 degrees C. Cycling to even higher temperatures can be tolerated but with some reduced life time. This particular design is preferred since it provides spacings large enough for water vapor and gases to pass through easily. The structure is very absorptive of the microwave energy. Much larger spacings would permit much of the microwave energy to pass through.

Experiments

Experiments were conducted to prove effectiveness of the microwave heated silicon carbide shroud in incinerating garbage. A 1.5 inch OD silicon carbide cylinder, 2 inches long and open at both ends was insulated with 1 inch of fiberglass on sides and bottom. The tube was heated from the top with a 1 KW magnetron. The temperature increased to equilibrium in about three minutes and produced a dull red glow at the bottom indicating a temperature of about 600 to 700 degrees C.

Various typical garbage items were incinerated in the experimental unit with the following results:

Paper

A small piece of paper towel flamed in about 1 minute with little smoke and no visible residue.

Orange Peel

A ½ inch diameter piece of orange peel glowed like charcoal. After about 6 minutes left a slight residue.

Chicken Wing Bone

After 3 minutes dense clouds of smoke were produced. Wing smoked for about 15 minutes. Bone was taken out examined and replaced in oven. After 2 minutes of further heating the bone smoked for 1 minute then burst into flame for 2 minutes. After five minutes bone was completely white but still held shape; however, it was easily crushed under very slight pressure.

Other Embodiments

Many other embodiments of the present invention other than the one described in detail above are possible. Some examples of variations are discussed below:

Methods of Collecting Vapors and Ash

Figure 4:
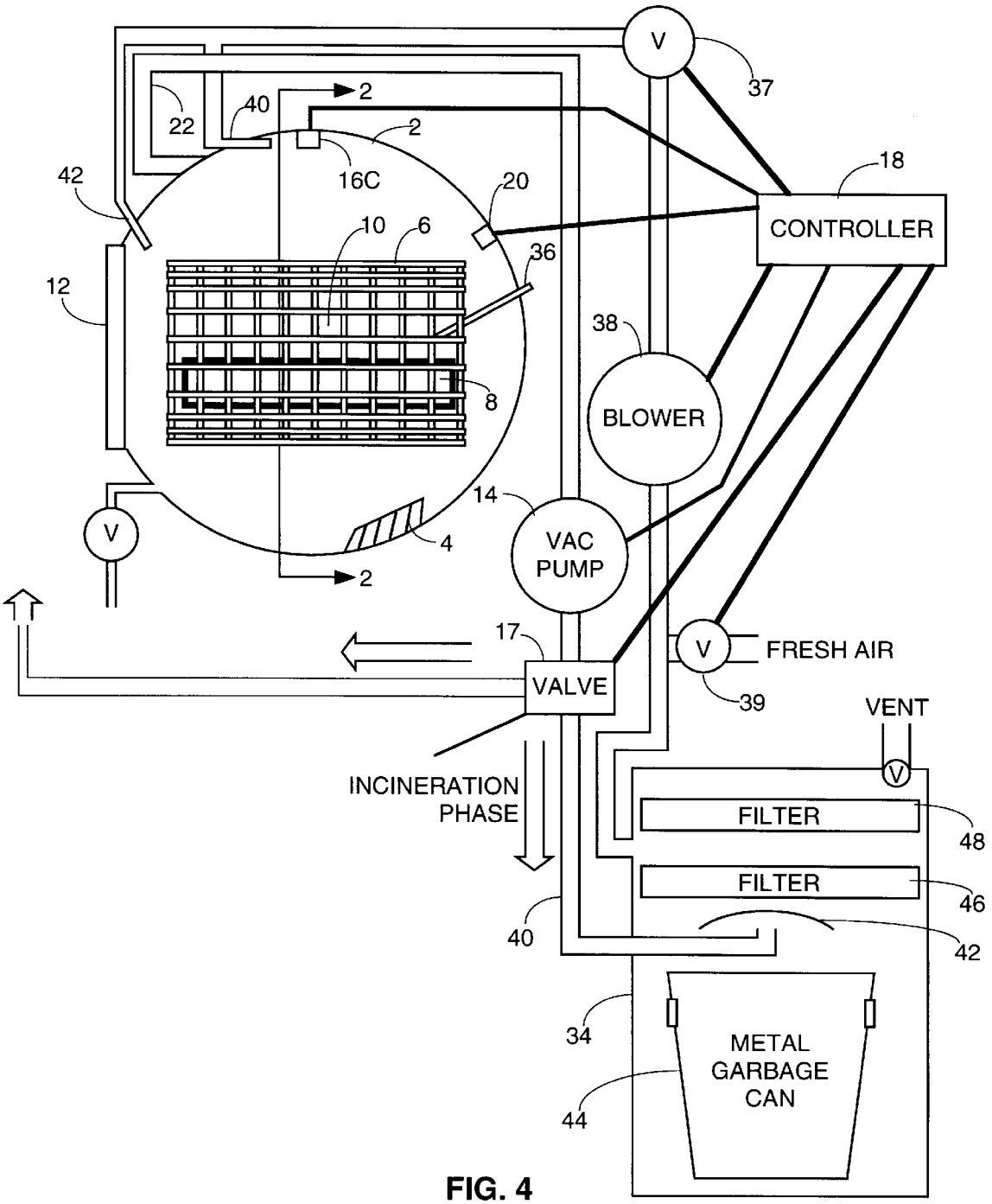
FIG. 4 is a drawing of a third preferred embodiment.

There are many other methods for collecting the vapors and the ash other than the method described. The vapors could be merely vented to the atmosphere as indicated in FIG. 4, and the ash could be removed by removing garbage tray 8 through door 12 by hand and dumping the ash into a suitable container or down the toilet. Also, the ash as well as condensed vapors could be plumbed directly to sewage drains.

Other Shroud Designs

Figure 3:
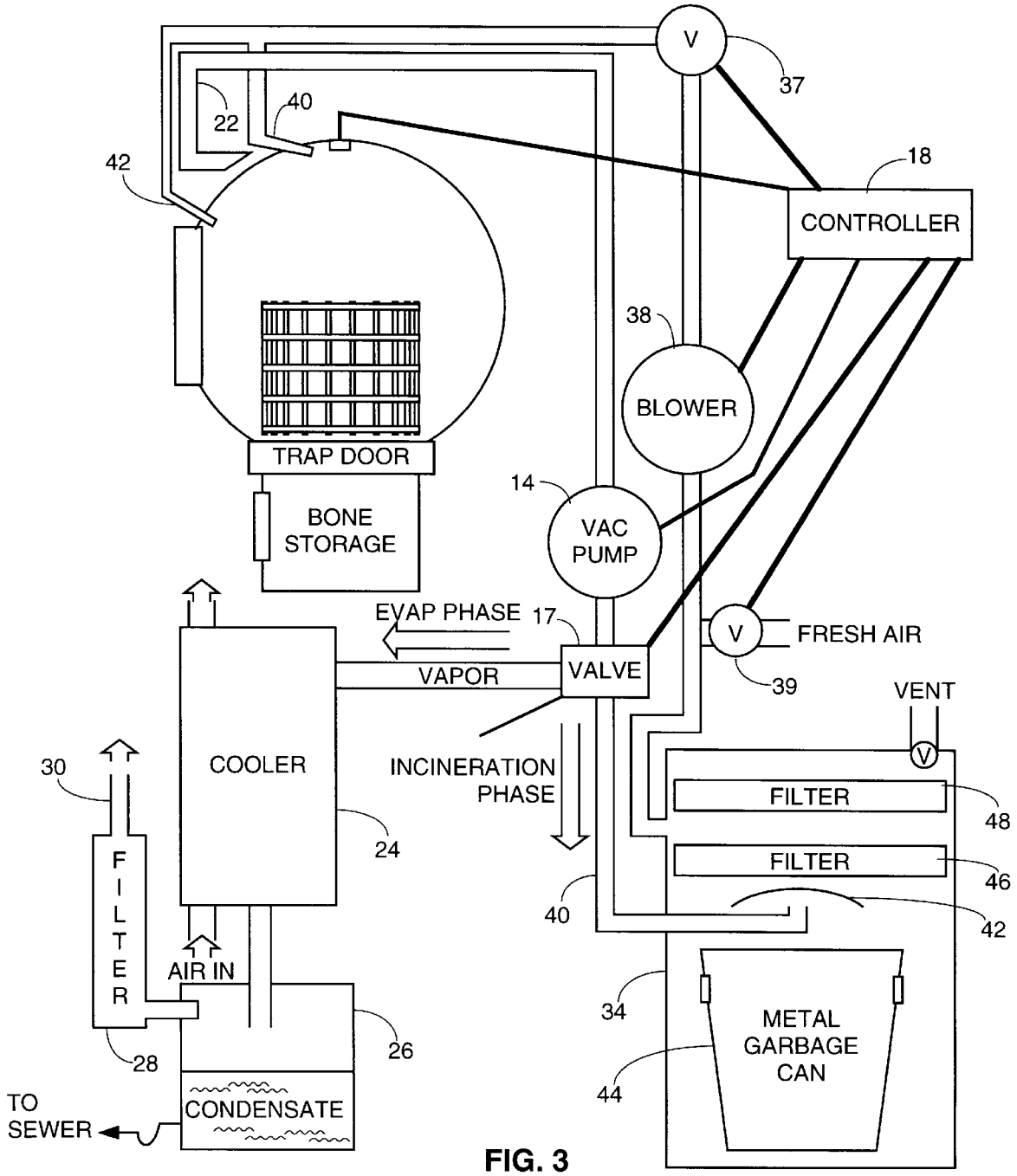
FIG. 3 is a drawing of a second preferred embodiment.

Alternate shroud designs could be utilized. One such alternate design is shown in FIG. 3. This shroud design is also in the shape of a cylindrical tube but stands vertical. A trap door is provided just below the tube so that ash (such as charred bone), which cannot be vacuumed out of chamber 2, could automatically be removed by merely opening the trap door. Another possible design of the shroud would be to completely encase the garbage. This could be done by providing a silicon carbide end pieces for the shroud shown in FIG. 1 (one end piece functioning as a door).

Shroud Materials

Braided tubes formed from silicon carbide fiber can be substituted for the carbon fiber braided tubes discussed above. Aluminum oxide braided fiber tubes could also be utilized. In accordance with the process described in U.S. Pat. No. 5,154,862, particles or fibers can be added to the vapor deposition stream. If long fibers are used, the spacings between the strands will tend to become substantially smaller or disappear. The preferred range of silicon carbide thickness is between 10 mills and 100 mills. Powders can be added to the vapor stream which will increase or decrease the microwave absorption in the coating. Powders can also be added through the CVD process to adjust the resistivity and/or temperature coefficient of the shroud material. These powders could include carbon, ceramic and even metal particles. Fibers added to the stream can substantially increase the toughness and strength of the tube. These fibers are typically 5 microns to 50 microns diameter and are in the range of about 1/10 inch long. The material for the shroud does not have to be silicon carbide. But the shroud should be of a material that readily absorbs microwave energy and is capable of withstanding high temperatures and many hundreds or thousands of temperature cycles. Other high temperature ceramic microwave absorbing materials which could be used.

Igniter

The igniter shown as 36 in FIG. 1 is optional. The igniter would provide an additional control as to the precise moment of the beginning of combustion. The igniter would normally not be necessary if during the incineration phase the shroud temperature is increased quickly to 600 degrees C. to about 1000 degrees C.

Other Applications

Although the embodiments shown in the drawing have been discussed primarily in terms of residential incineration use, persons skilled in the art will recognize many other applications for the concepts and principals disclosed herein. For example, the incinerator can be used for disposal of hazardous waste. In such use some obvious modifications may need to be made to assure that vent gases and ash are properly dealt with. By making the unit much larger it could be used as a cremation device for pets, or if still larger, with substantial increase of microwave power, the unit could be used as a human cremation device. Also, there could be many other uses in the residence for the described device in addition to incineration of garbage. The device could, for example, be used for very fast cooking. It could be used for drying. It could be used as a kiln for many applications. In some isolated locations where sewage disposal is a problem, the device could be modified to treat sewage.

The foregoing description of the present invention has been presented for the purpose of illustration and is not intended to limit the invention to the precise form disclosed. It is understood that many modifications and changes may be effected by those skilled in the art. Accordingly, it is intended that the claims will cover all modifications and changes as fall within the true spirit and scope of the invention.

I claim:

1. A method for incinerating waste material comprising the steps of:

A) disposing said waste material within a microwave absorbing shroud located inside a chamber, B) drying said waste material by applying at least a partial vacuum within said chamber and applying heat to said waste material by radiating said microwave absorbing shroud with microwave radiation, C) applying additional microwave radiation to said shroud after the drying step in order to heat the microwave absorbing shroud to an elevated temperature effective to support combustion of said waste material remaining after the drying, D) admitting oxygen-containing gas into said chamber while continuing heating of the microwave absorbing shroud so as to combust said waste material, wherein said dried waste material is incinerated by the combination of (i) heat transmitted to the waste material from said shroud and (ii) combustion of the waste material in the oxygen in said oxygen-containing gas.

2. A method of incinerating waste material as in claim 1 and further comprising the step of vacuuming ash resulting from said incinerated waste into an ash receptacle.

3. A method of incinerating waste material as in claim 2 wherein said steps of applying vacuum, applying heat, admitting oxygen-containing gas and vacuuming ash are all controlled by a programmable controller.

4. A method of incinerating waste material as in claim 1 wherein said steps of applying vacuum, applying heat and admitting oxygen-containing gas are all controlled by a programmable controller.

5. A method for incinerating waste material comprising the steps of:

A) disposing said waste material within a microwave absorbing shroud located inside a chamber, B) drying said waste material by applying at least a partial vacuum within said chamber and applying heat to said waste material by radiating said microwave absorbing shroud with microwave radiation, C) applying additional microwave radiation to said shroud after the drying step in order to heat the microwave absorbing shroud to an elevated temperature effective to support combustion of said waste material remaining after the drying, D) admitting oxygen-containing gas into said chamber while continuing heat of the microwave absorbing shroud so as to combust said waste material, wherein said dried waste material is incinerated by the combination of (i) heat transmitted to the waste material from said shroud and (ii) combustion of the waste material in the oxygen in said oxygen-containing gas, wherein said microwave absorbing shroud comprises a silicon carbide coated braided fiber tubular preform.

6. An incinerator for incinerating waste material comprising:

A) a chamber,

B) a microwave absorbing shroud disposed inside said chamber and having an internal cavity for receiving said waste material, C) a microwave generator positioned to direct microwave radiation into said chamber so as to heat said shroud, D) a vacuum pump configured to draw at least a partial vacuum within said chamber, and E) a blower configured to provide oxygen-containing air to said chamber, and F) a controller for operating said incinerator so that said waste material inside said microwave absorbing shroud is:

1) dried under at least partial vacuum provided by said vacuum pump, by heat from said microwave absorbing shroud which heat is applied by said microwave generator to said shroud, and then 2) incinerated at least in part by additional heat applied by said microwave generator and oxygen provided by said blower.

7. An incinerator as in claim 6 wherein said shroud is configured in the general form of a tube.

8. An incinerator as in claim 7 wherein said shroud is comprised of silicon carbide.

9. An incinerator as in claim 7 wherein said shroud is oriented horizontally.

10. An incinerator as in claim 6 wherein said controller is a programmable controller means for controlling the operation of said microwave generator, said vacuum pump and said blower.

11. An incinerator as in claim 10 and further comprising an ash receptacle, wherein said controller is programmed to operate said blower and said vacuum pump to vacuum ash generated in said chamber into said ash receptacle.

12. An incinerator as in claim 6 and further comprising a condenser to condense moisture evaporated from said waste material.

13. An incinerator as in claim 6 further comprising a waste tray insertable into the chamber to hold said waste material.

14. An incinerator for incinerating waste material comprising:

A) a chamber,

B) a microwave absorbing shroud, comprised of silicon carbide deposited on a braided fiber tubular preform and configured in the general form of a tube, disposed inside said chamber and having an internal cavity for receiving said waste material, C) a microwave generator positioned to direct microwave radiation into said chamber so as to heat said shroud, D) a vacuum pump configured to draw at least a partial vacuum within said chamber, and E) a blower configured to provide oxygen-containing air to said chamber, and F) a controller for operating said incinerator so that said waste material inside said microwave absorbing shroud is:

1) dried under at least partial vacuum provided by said vacuum pump, by heat from said microwave absorbing shroud which heat is applied by said microwave generator to said shroud, and then 2) incinerated at least in part by additional heat applied by said microwave generator and oxygen provided by said blower.

15. An incinerator as in claim 14 wherein said braided fiber tubular preform is an open mesh braided fiber tubular preform.

16. An incinerator as in claim 15 wherein said open mesh braided fiber tubular preform is comprised of carbon fibers.

17. An incinerator as in claim 14 wherein said braided fiber tubular preform is comprised of carbon fibers.

18. An incinerator as in claim 14 wherein said braided fiber tubular preform is comprised of ceramic fibers.

19. An incinerator as in claim 18 wherein said ceramic fibers are chosen from a group consisting of silicon carbide and aluminum oxide.

20. An incinerator for incinerating waste material comprising:

a chamber;

a microwave absorbing element disposed inside said chamber;

a microwave generator positioned to direct microwave radiation into said chamber so as to heat the microwave absorbing element;

a vacuum pump positioned to draw at least a partial vacuum within the chamber; and a controller to operate the incinerator so that waste material inside the chamber is:

dried, under at least partial vacuum provided by said vacuum pump, by heat emitted from said microwave absorbing element, which heat is induced by heating of said element by said microwave radiation; and incinerated at least in part in the presence of oxygen subsequently admitted to the chamber.

21. The incinerator of claim 20 wherein said microwave absorbing element is configured to at least partially enclose said waste material.

22. The incinerator of claim 20 wherein said microwave absorbing element is a microwave absorbing shroud configured with an internal cavity for receiving said waste material.

23. The incinerator of claim 20 wherein said oxygen-containing gas is ambient air and wherein the incinerator further comprises a blower to introduce said ambient air to the chamber.

24. The incinerator of claim 20 further comprising a condenser to condense moisture extracted by said vacuum pump.

25. A method for incinerating waste material comprising the steps of:

A) disposing said waste material within a microwave absorbing shroud located inside a chamber, B) drying said waste material by applying at least a partial vacuum within said chamber and applying heat to said waste material by radiating said microwave absorbing shroud with microwave radiation, C) heating said waste material by applying additional microwave radiation to said shroud after the drying step in order to heat the microwave absorbing shroud to an elevated temperature effective to support combustion of said waste material remaining after the drying, D) admitting oxygen-containing gas into said chamber while continuing heating of the microwave absorbing shroud so as to combust said waste material.

26. The method of claim 25 further comprising condensing vapor generated by the drying step.

27. The method of claim 25 wherein the heating step heats the microwave absorbing shroud to a temperature in excess of 500 degrees C.

28. The method of claim 25 further comprising inducing air flow through the chamber to carry ash from said waste material to an ash collector.

29. An apparatus for heating material comprising:

A) a vacuum chamber;

B) a microwave absorbing shroud formed as an open mesh silicon carbide tube disposed inside said vacuum chamber and having an internal cavity for receiving said material;

C) a microwave generator positioned to direct microwave radiation into said chamber so as to heat said shroud;

D) a vacuum pump configured to draw at least a partial vacuum within said vacuum chamber;

E) a gas source configured to provide oxygen-containing gas to said chamber; and F) a controller for operating the apparatus so that said material inside said microwave absorbing shroud is dried under at least partial vacuum provided by said vacuum pump, by heat from said microwave absorbing shroud which heat is applied by said microwave generator to said shroud, 2) incinerated at least in part by additional heat applied by said microwave generator and oxygen provided by said gas source.

30. A method of manufacturing an apparatus for heating material comprising:

A) providing a chamber;

B) providing a microwave absorbing shroud having an internal cavity for receiving said material by:

a) providing an open mesh tube formed of a heat-resistant first material;

b) then depositing a coating of a heat-resistant and microwave-absorbing second material on said tube; and c) then disposing said tube inside said vacuum chamber;

C) providing a microwave generator positioned to direct microwave radiation into said chamber so as to heat said shroud;

D) providing a controller for operating the apparatus so that said material inside said microwave absorbing shroud is heated by heat from said microwave absorbing shroud which heat is applied by said microwave generator to said shroud.

31. The method of claim 30 wherein:

the open mesh tube is formed of carbon fiber; and the second material substantially comprises silicon carbide and is deposited on the tube by vapor deposition.

32. The method of claim 30 wherein the coating of the heat-resistant and microwave-absorbing second material is deposited on said tube by:

placing the open mesh tube in a cylindrical tube; and vapor depositing the second material on the open mesh tube while rotating and heating the cylindrical tube so that the open mesh tube rolls within the cylindrical tube.

33. The method of claim 30 further comprising the steps of:

providing a vacuum pump configured to draw at least a partial vacuum within said chamber; and providing a gas source to provide oxygen-containing gas to said chamber, wherein the controller is configured to dry the material under at least partial vacuum provided by said vacuum pump.

34. An incinerator for incinerating waste material comprising:

a chamber;

a microwave absorbing element disposed inside said chamber;

a microwave generator positioned to direct microwave radiation into said chamber so as to heat the microwave absorbing element;

a vacuum pump positioned to draw at least a partial vacuum within the chamber; and a controller configured to operate the incinerator so that waste material inside the chamber is:

dried, under at least partial vacuum provided by said vacuum pump, by heat emitted from said microwave absorbing element, which heat is induced by heating of said element by said microwave radiation; and incinerated at least in part in the presence of oxygen subsequently admitted to the chamber.

35. The incinerator of claim 34 wherein the oxygen is contained in air blown into the chamber.

36. The incinerator of claim 34 wherein the controller is configured to control temperature of the waste material and oxygen content in the chamber during incineration of the waste material by controlling recirculation of exhaust gasses from the chamber.

37. An incinerator for incinerating waste material comprising:

a chamber;

a microwave absorbing element disposed inside said chamber;

a microwave generator positioned to direct microwave radiation into said chamber so as to heat the microwave absorbing element;

a vacuum pump positioned to draw at least a partial vacuum within the chamber; and a controller configured to operate the incinerator so that waste material inside the chamber is:

dried, under at least partial vacuum provided by said vacuum pump, by heat emitted from said microwave absorbing element, which heat is induced by heating of said element by said microwave radiation; and incinerated at least in part in the presence of oxygen subsequently admitted to the chamber;

a first exhaust flow path;

a second exhaust flow path at least partially separate from the first exhaust flow path; and an ash collector in the second exhaust flow path, wherein the controller is configured to control the vacuum pump to direct an exhaust flow from the chamber through the first exhaust flow path during drying of the waste material and to direct an exhaust flow from the chamber through the second exhaust flow path after incineration of the waste material.

38. The incinerator of claim 37 further comprising a condenser in the first exhaust flow path to condense moisture evaporated from the waste material during drying of the waste material.

39. An incinerator for incinerating waste material comprising:

a chamber;

a microwave absorbing element disposed inside said chamber;

a microwave generator positioned to direct microwave radiation into said chamber so as to heat the microwave absorbing element;

a vacuum pump positioned to draw at least a partial vacuum within the chamber; and a controller configured to operate the incinerator so that waste material inside the chamber is:

dried, under at least partial vacuum provided by said vacuum pump, by heat emitted from said microwave absorbing element, which heat is induced by heating of said element by said microwave radiation; and incinerated at least in part in the presence of oxygen subsequently admitted to the chamber a first inlet flow path from a source of a gas contain said oxygen;

a second inlet flow path at least partially separate from the first inlet flow path; and an ash collector in the second inlet flow path, wherein the controller is configured to operate the incinerator to direct a first inlet flow of said gas containing said oxygen to the chamber through the first inlet flow path during incineration of the waste material and to direct a second inlet flow gas to the chamber through the second inlet flow path after incineration of the waste material, the second inlet flow at least in part a closed loop flow from the chamber, to the ash collector and back to the chamber.

40. The incinerator of claim 39 wherein the ash collector comprises a filter in the second inlet flow path.

* * * * *